US006719278B2

(12) United States Patent
Bryan

(10) Patent No.: US 6,719,278 B2
(45) Date of Patent: Apr. 13, 2004

(54) HANDRAIL SYSTEM AND KIT

(75) Inventor: Bob Bryan, Etobicoke (CA)

(73) Assignee: Brite Manufacturing Inc., Bolton (CA)

( * ) Notice: Subject to any disclaimer, the term of this patent is extended or adjusted under 35 U.S.C. 154(b) by 0 days.

(21) Appl. No.: 09/802,879

(22) Filed: Mar. 12, 2001

(65) Prior Publication Data

US 2002/0134977 A1 Sep. 26, 2002

(51) Int. Cl.[7] ..... E04H 17/00

(52) U.S. Cl. ..... 256/65.01; 256/59; 256/66; 256/65.08; 403/230

(58) Field of Search ..... 256/19, 24, 59, 256/65.01, 65.02, 66, 65.08

(56) References Cited

U.S. PATENT DOCUMENTS

| | | | | | |
|---|---|---|---|---|---|
| 3,689,032 | A | * | 9/1972 | Von Wedel et al. | 256/22 |
| 3,858,850 | A | * | 1/1975 | Maxcy et al. | 256/22 |
| 3,955,799 | A | * | 5/1976 | Lauzier | 256/21 |
| 3,955,800 | A | * | 5/1976 | Russo | 256/59 |
| 3,962,774 | A | | 6/1976 | Noro | |
| 4,014,520 | A | * | 3/1977 | Walters | 256/22 |
| 4,269,532 | A | | 5/1981 | Sorrentino | |
| 4,403,767 | A | * | 9/1983 | Basey | 256/59 |
| 4,514,197 | A | * | 4/1985 | Armbruster | |
| 4,593,344 | A | * | 6/1986 | Basile | |
| 4,885,882 | A | | 12/1989 | Forshee | |
| 5,186,528 | A | * | 2/1993 | Schardt et al. | |
| 5,261,205 | A | * | 11/1993 | Sandor | |
| 5,326,187 | A | * | 7/1994 | St. Marie et al. | 403/205 |
| 5,370,368 | A | * | 12/1994 | Terrels et al. | 256/19 |
| 5,458,942 | A | | 10/1995 | Miller | |
| 5,551,575 | A | * | 9/1996 | Leone | |
| 5,572,845 | A | | 11/1996 | DeSouza | |
| 5,794,390 | A | | 8/1998 | Oliveri et al. | |
| 5,900,379 | A | * | 5/1999 | Noda et al. | |
| 5,913,754 | A | * | 6/1999 | Lochbaum | |
| 5,957,437 | A | | 9/1999 | Savenok | |
| 6,017,019 | A | | 1/2000 | Erwin | |
| 6,029,954 | A | * | 2/2000 | Murdaca | 256/24 |
| 6,053,480 | A | * | 4/2000 | De Guise | 256/22 |
| 6,068,138 | A | * | 5/2000 | Carlson et al. | |
| 6,126,007 | A | * | 10/2000 | Kari et al. | |
| 6,152,428 | A | * | 11/2000 | Simioni | 256/19 |
| 6,308,937 | B1 | * | 10/2001 | Pettit | 256/65.05 |
| 6,398,193 | B1 | * | 6/2002 | DeSouza | 256/19 |

* cited by examiner

*Primary Examiner*—Lynne H. Browne
*Assistant Examiner*—Ryan M Flandro

(57) ABSTRACT

A composite handrail system comprises a plurality of upright posts. A plurality of composite rails extends between adjacent upright posts at two points on the adjacent upright posts, the composite rails each having an internal reinforcing element, friction fitted into a composite channel extending longitudinally inside each composite rail, and a composite cover friction fitted over each composite channel. A plurality of composite sleeve-spindles extends between the composite rails, and a plurality of connectors couples the composite rails to the composite sleeve-spindles. The connectors are adapted to be mounted to the composite rails, and are adapted to receive and friction fit to the composite sleeve-spindles.

11 Claims, 3 Drawing Sheets

HANDRAIL SYSTEM AND KIT

FIELD OF THE INVENTION

The present invention relates generally to a handrail and more specifically to a composite handrail assembly comprising a novel connector and covering, and a kit comprising the handrail system.

BACKGROUND OF THE INVENTION

Deck systems are used both commercially and residentially and often require a handrail to ensure maximum safety to the users. A handrail helps ensure that the people using the deck do not fall off. Furthermore a handrail is also important for any stairway attached to the deck to ensure the safety of the users as they go up and down the stairs to the deck.

Traditionally decks and associated handrails have been manufactured from solid wood or some form of wood product. As such the decks and handrails have been susceptible to damage from the elements such as rain, snow and wind. Therefore the production of the deck and handrail from an alternative more sturdy material has been desirable. The industry has therefore turned to plastic to address some of these problems, although plastic has restrictions with respect to the amount of weight it can carry and its strength.

A number of different patents and inventions have tried to address the issue of strong decking and railing with improved durability for the outdoors. For example U.S. Pat. No. 6,017,019 issued on Jan. 25, 2000 to Erwin. This patent relates to a modular railing including a plurality of upright posts and a plurality of composite handrails extending between adjacent ones of the upright posts. The composite handrails each include a plastic outer shell and an internal metal reinforcing element extending longitudinally within the plastic shell.

DeSouza is the owner of U.S. Pat. No. 5,572,845, which issued on Nov. 12, 1996. This patent relates to a wood railing assembly for use between vertical posts, which may be attached to a wood deck, utilizes top and bottom rails together with a middle rail.

Savenok is the owner of U.S. Pat. No. 5,957,437, which issued on Sep. 28, 1999 and relates to a balustrade connecting structure. The connecting structure is used to connect the rail to a support structure and is constructed to be recessed into an end of a rail to enable the connection of the rail to the support structure.

Forshee is the owner of U.S. Pat. No. 4,885,882 which issued on Dec. 12, 1989. This patent relates to a cover for a wooden deck structure which protects people walking on the deck structure from splinters. In one embodiment, the cover is in the form of a thin walled, U-shaped channel member which fits over one board of the deck structure. In doing so, the central section of the channel member overlies the top of the board while the sides of the channel member extend downwardly along the sides of the boards.

Oliveri et al. is the owner of U.S. Pat. No. 5,794,390, which issued on Aug. 18, 1998. This patent relates to a structural covering that is attachable to a rail of a railing that has a top, a pair of sides, ends, and a bottom, and that is attachable to a floor board of a deck that has a top, a pair of sides, ends and a bottom, while covering most of the rail of the railing and any exposed ends thereof and covering most of the floor board of the deck and any exposed ends thereof so as to prevent splinters, hide knots, splintered wood, discolored wood, and cracks in the wood, and give a uniform look that will not rot.

Sorrentino is the owner of U.S. Pat. No. 4,269,532 which issued on May 26, 1981. This patent relates to a coupling for joining tubing together in the manufacture of furniture and the like comprising a pair of sleeves mounted one on the other in coplanar relation with their axes at right angle to each other and a wall mounted at the inner end of one of the sleeves with an opening in the wall for receiving a screw and the like for fastening the tubing that extends through the other sleeve.

Although the above noted prior art addresses some of the problems associated with decks and associated handrails the prior art does not provide for a handrail system and kit that can be easily assembled, while completely covering or hiding the fasteners resulting in a finished, clean professional look. Furthermore, the handrail system may be installed on an angle for stairs that mount to the deck, or straight on the deck itself. Finally the handrail system has composite elements which allows for easy installation as well as improved strength while maintaining the look and feel of a wooden deck.

SUMMARY OF THE INVENTION

In accordance with one aspect of the present invention there is provided an improved composite handrail system consisting of a plurality of upright posts and a plurality of composite rails extending between adjacent upright posts at two points on the adjacent upright posts. The composite rails may each have an internal reinforcing element which may be friction fitted into a composite channel extending longitudinally inside each composite rail. A composite cover may be friction fitted over the composite channel. A plurality of composite sleeve-spindles may extend between the composite rails. A plurality of connectors may couple the composite rails to the composite sleeve-spindles. The connectors may be adapted to mount to the composite rails and are adapted to receive and friction fit to the composite sleeve-spindles.

Conveniently the internal reinforcing element may be a wood member and the composite channel may be adapted to encase the wood member to provide a consistent profile for the composite rail. Preferably the connectors may be hollow and have an outer wall and an inner wall, and a plurality of covered channels extending the length of the inner wall of the connectors. The covered channels may be adapted to receive a series of fasteners for mounting the connectors to the composite rails.

Advantages of the present invention are that the handrail system may be installed on an angle or straight; once assembled, all fasteners are completely hidden. The composite handrail system has the strength of wood and looks like wood; and the composite rails allow for improved strength of the handrail system. The composite rail also allows for inconsistencies in the wood member, and provide easier installation, improved finish, easier assembling and fastening, and friction fit of elements. The connector allow for easy placement of sleeve-spindles on the rails, a snug fit without rotation, and easy installation.

BRIEF DESCRIPTION OF THE DRAWINGS

A detailed description of the preferred embodiments are provided herein below by way of example only and with reference to the following drawings in which.

Figure 1:
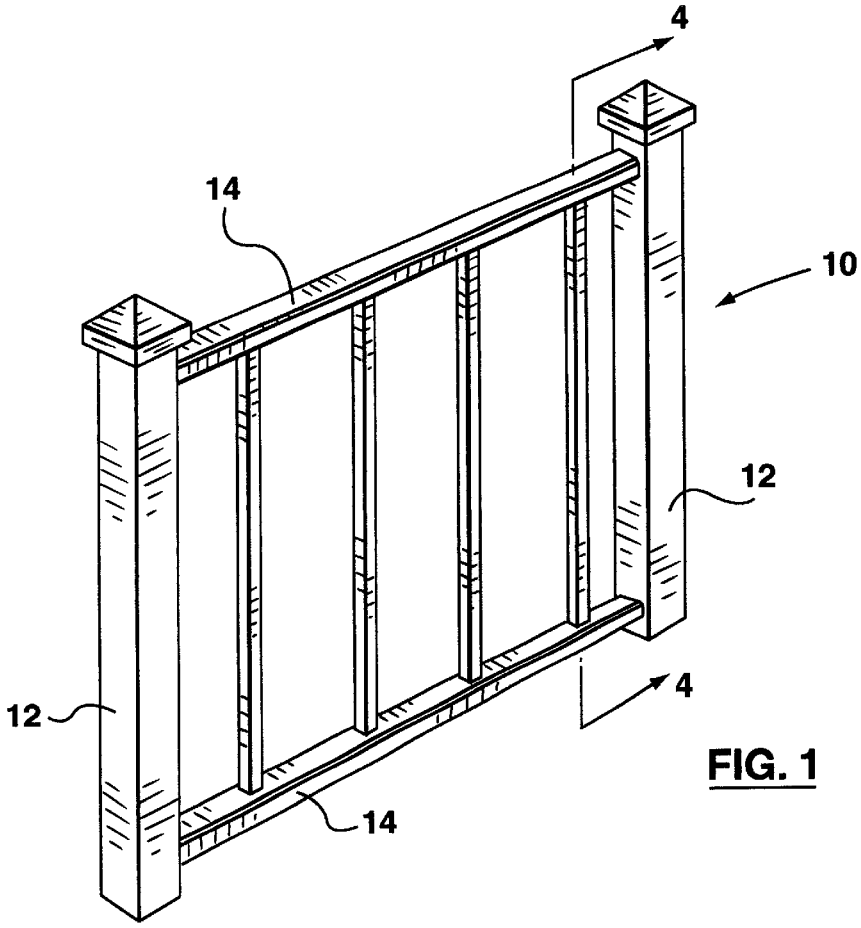
FIG. 1, in a top perspective view, illustrates the handrail system in accordance with the first preferred embodiment of the present invention.

In the drawings, preferred embodiments of the invention are illustrated by way of example. It is to be expressly understood that the description and the drawings are only for the purpose of illustration and as an aid to the understanding and are not intended as a definition of the limits of the invention.

DETAILED DESCRIPTION OF THE PREFERRED EMBODIMENTS

Figure 2:
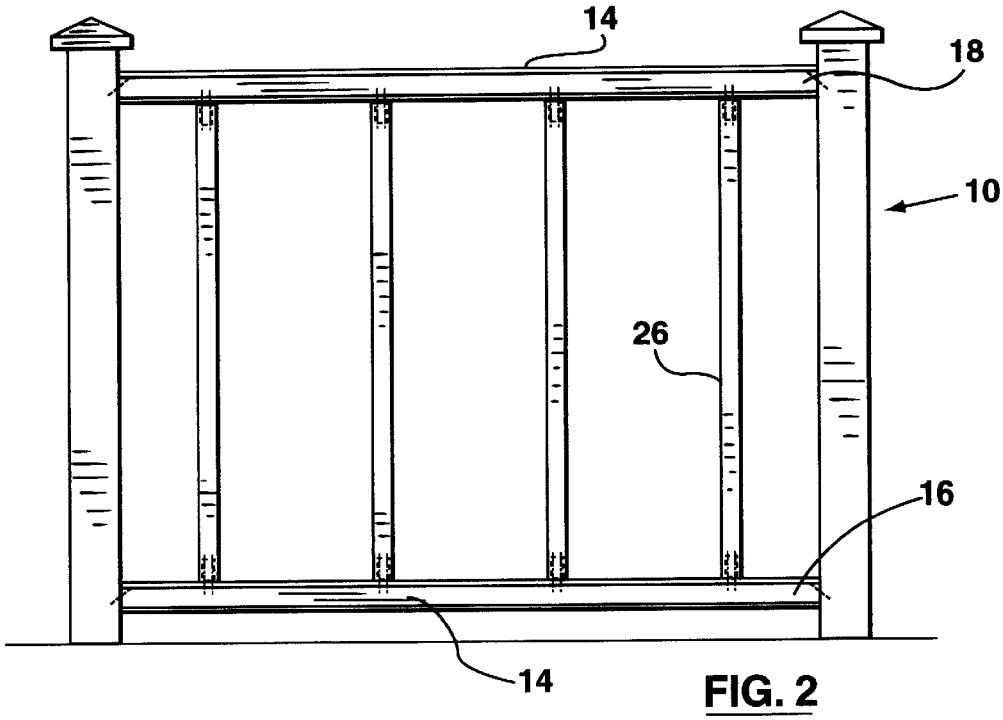
FIG. 2, in front plan view, illustrates the handrail system of FIG. 1.
Figure 3:
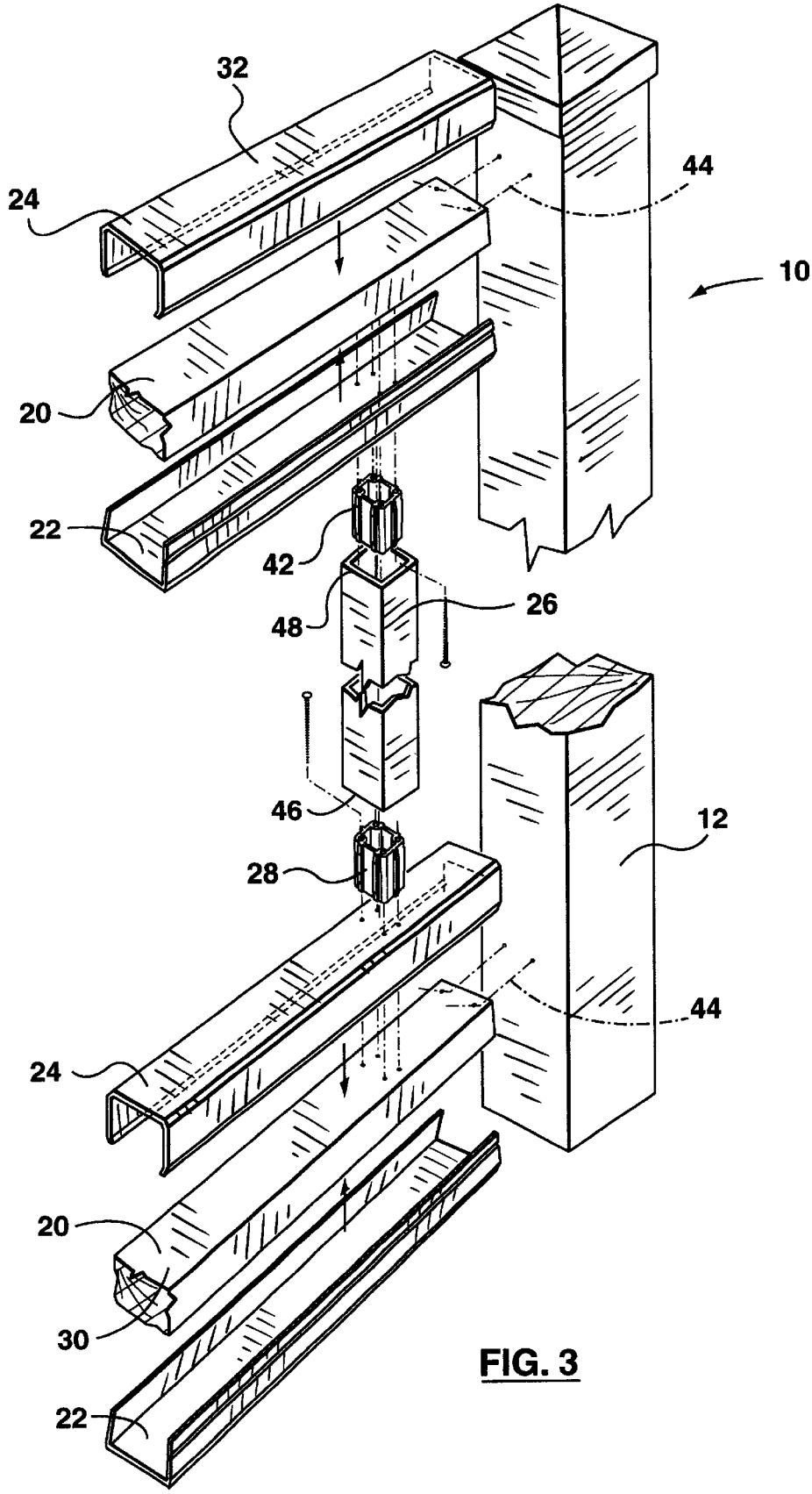
FIG. 3, in an exploded view, illustrates the handrail system and the handrail system kit of the present invention.

Referring to FIGS. 1, 2, and 3, there is illustrated in perspective and exploded views, a handrail system 10 in accordance with a preferred embodiment of the present invention. The handrail system 10 includes a plurality of upright posts 12 and a plurality of composite rails 14 extending between adjacent upright posts 12 at two points 16 and 18 on the adjacent upright posts 12. The composite rails 14 may each have an internal reinforcing element 20 which may be friction fitted into a composite channel 22 extending longitudinally inside each composite rail 14.

A composite cover 24 may be friction fitted over the composite channel 22. A plurality of composite sleeve-spindles 26 may extend between the composite rails 14. A plurality of connectors 28 may couple the composite rails 14 to the composite sleeve-spindles 26. The connectors 28 may be adapted to mount to the composite rails 14 and are adapted to receive and friction fit to the composite sleeve-spindles 26.

The internal reinforcing element 20 may be a wood member 30 that may be adapted to friction fitted into the composite channel 22 providing a snug fit between the wood member 30 and the composite channel 22. By encasing the wood member 30 in the composite channel 22, any inconsistencies in the wood member 30 are overcome as the composite channel 22 can flex around the wood member 30, and has sufficient space to completely encase the wood member 30. The composite cover 24 may be a channel cover 32 adapted to friction fit over the composite channel 22 without requiring fasteners. The resulting composite rail 14 therefore includes the strength from the internal reinforcing element 20 or wood member 30, while providing a clean profile from the friction fit of the channel cover 32 over the composite channel 22 while doing away with the need for fasteners. Finally the composite channel 22 and channel cover 32 assembly allows for easier installation since it requires fewer parts.

Figure 4:
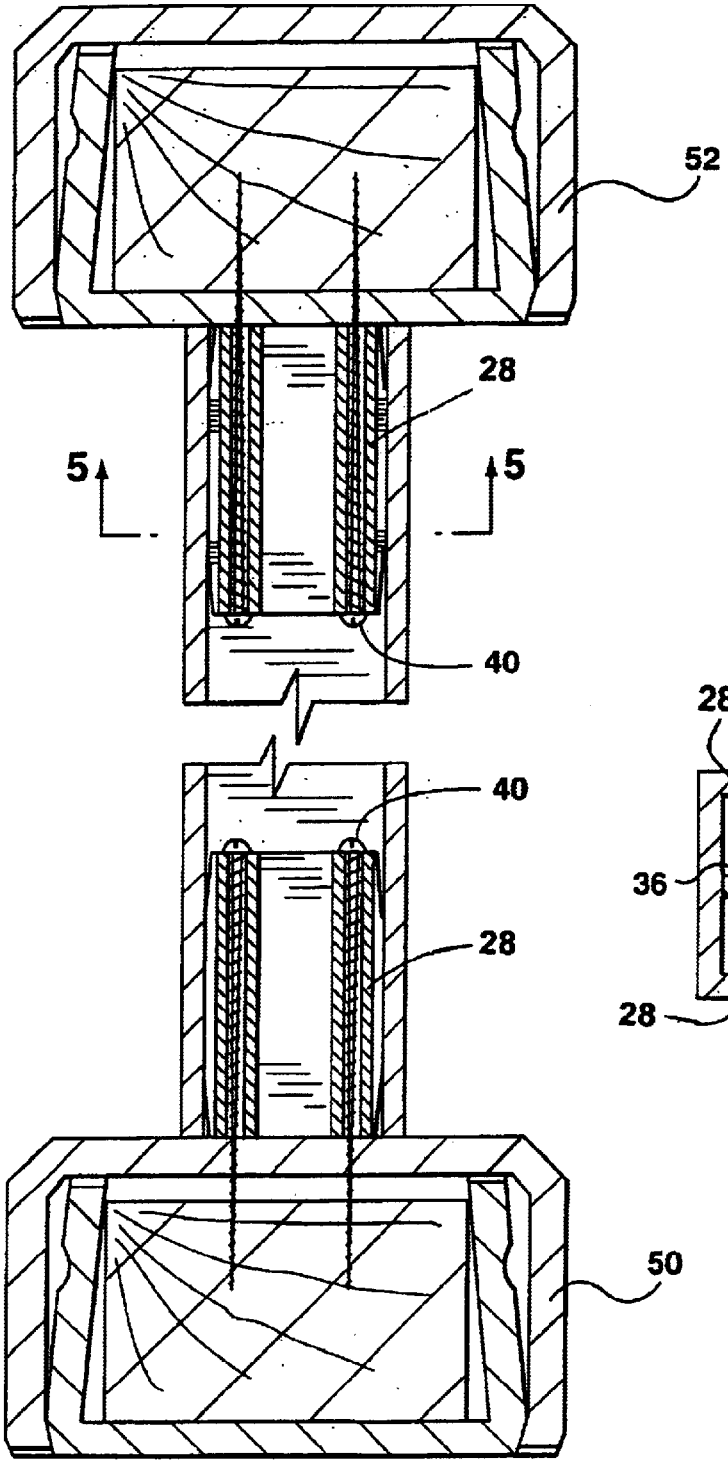
FIG. 4, in a side cross-section view, illustrates the composite rail of the present invention and a connector of the present invention, in operation.
Figure 5:
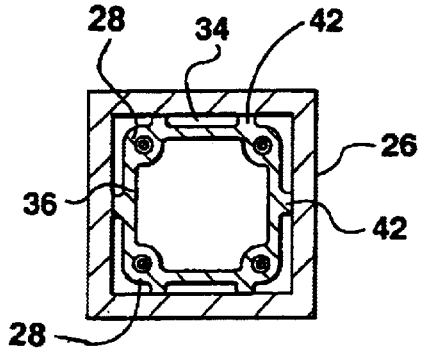
FIG. 5, in a top cross-sectional view, illustrates the connector.

Referring to FIGS. 4 and 5, the connectors 28 may be hollow and have an outer wall 34 and an inner wall 36 and a plurality of covered channels 38 extending the length of the inner wall 36 of the connectors 28. The covered channels 38 may be adapted to receive a series of screw fasteners 40 for mounting the connectors 28 to the composite rails 14. The connectors 28 may be mounted not only flush or straight to the composite rails 14, but they may also be cut at an angle to allow for installation of the connectors 28 and the composite sleeve-spindles 26 for stairs that mount the deck.

The connectors 28 may further comprise a series of ribs 42 on the outer wall 34 for the friction fit of the composite sleeve-spindles 26 and to prevent rotation of the composite sleeve-spindles 26 on the connectors 28. Furthermore the connectors 28 may be tapered on either end to allow for easy insertion into composite sleeve-spindles 26.

A kit for a handrail system is also disclosed which includes the constituent parts described above which are adapted to be assembled together in connected relationship in differing handrail systems providing correspondingly different handrail system appearances and characteristics.

Referring to FIGS. 2 to 4, in operation, the handrail system's method of assembly includes the following steps. The user may first position a pair of upright posts 12 apart from one another in the desired position. A first composite rail 50 is positioned between the adjacent upright posts 12 at a first point 16 to the adjacent upright posts 12. The composite rail 50 may have an internal reinforcing element 20 which is friction fitted into a composite channel 22 that extends longitudinally inside the composite handrail 50.

The composite rail 50 may be secured to the upright posts 12 with screw fasteners 44. A composite cover 24 is friction fitted over the composite channel 22 of the composite rail 14 thereby covering the internal reinforcing element 20 and the screw fasteners 44. A plurality of connectors 28 which are adapted to be mounted to the composite rails 50 are attached at desired points along the composite rail 50. The connectors 28 are also adapted to receive and friction fit to a plurality of composite sleeve-spindles 26, which have a first end 46 and a second end 48. The first end 46 of composite sleeve-spindles 26 are friction fitted over the connectors 28.

A second composite rail 52 also having an internal reinforcing element 20 is friction fitted into a composite channel 22 extending longitudinally inside the composite rail 52 extending between the adjacent upright posts 12 at a second point 18 on the adjacent upright posts 12. A second plurality of connectors 28 is attached to the second composite rail 52 at desired points. The second plurality of connectors 28 are then friction fitted into the second end 48 of the composite sleeve-spindles 26, therefore resulting in the composite sleeve-spindles 26 extending between the first and second composite rails 50 and 52.

The second composite rail 52 is secured to the upright posts 12 with screw fasteners 44. A second composite cover 24 is friction fitted over the composite channel 22 of the second composite rail 52 thereby covering the internal reinforcing element 20 and the screw fasteners 44.

Other variations and modifications of the invention are possible. All modifications or variations are believed to be within the sphere and scope of the invention as defined by the claims appended hereto.

I claim:

1. A composite handrail system comprising:

(a) a plurality of upright posts;

(b) a plurality of composite rails extending between adjacent upright posts at two points on said adjacent upright posts, said composite rails each having an internal reinforcing element, friction fitted into a composite channel extending longitudinally inside said composite rail, and a composite cover friction fitted over said composite channel;

(c) a plurality of composite sleeve-spindles extending between said composite rails; and (d) a plurality of connectors coupling said composite rails to said composite sleeve-spindles, said connectors being adapted to be mounted to said composite rails and adapted to be received by and friction fitted to said composite sleeve-spindles;

wherein said connectors are hollow and have an outer wall and an inner wall; and wherein said connectors further comprise a plurality of covered channels extending the length of said inner wall of said connectors, and which are adapted to receive a series of screw fasteners for mounting said connectors to said composite rails.

2. The composite handrail system as claimed in claim 1 wherein said internal reinforcing element is a wood member friction fitted into said composite channel.

3. The composite handrail system as claimed in claim 2 wherein said composite channel is adapted to encase said wood member and provide a consistent profile for said composite rail.

4. The composite handrail system as claimed in claim 3 wherein said composite cover is a composite channel cover adapted to friction fit over said composite channel without requiring fasteners.

5. The composite handrail system as claimed in claim 1 wherein said connectors further comprise a series of ribs on said outer wall for the friction fit of said composite sleeve spindles and to prevent rotation of said composite sleeve spindles on said connectors.

6. The composite handrail system as claimed in claim 5 wherein said connectors are made from composite material.

7. A connector for a composite handrail system having a plurality of composite rails and composite sleeve-spindles, comprising a member adapted to be mounted to said composite rails and adapted to receive and friction fit to said sleeve-spindles for coupling said composite rails to said composite sleeve-spindles;

wherein said connector is hollow and has an outer wall and an inner wall; and wherein said connector further comprises a plurality of covered channels extending the length of said inner wall of said connector, and which are adapted to receive a series of screw fasteners for mounting said connector to said composite rails.

8. The connector claimed in claim 7 wherein said connector further comprises a series of ribs on said outer wall for the friction fit of said composite sleeve spindles and to prevent rotation of said composite sleeve spindles on said connector.

9. The connector as claimed in claim 8 wherein said connector is made from composite material.

10. A handrail system kit including constituent parts which are adapted to be assembled together in connected relationship in differing handrail systems providing correspondingly different handrail system appearances and characteristics, comprising:

(a) a plurality of upright posts;

(b) a plurality of composite rails extending between adjacent upright posts at two points on said adjacent upright posts, said composite rails each having an internal reinforcing element, friction fitted into a composite channel extending longitudinally inside said composite rail, and a composite cover friction fitted over said composite channel;

(c) a plurality of composite sleeve-spindles extending between said composite rails;

(d) a plurality of connectors coupling said composite rails to said composite sleeve-spindles, said connectors being adapted to be mounted to said composite rails and adapted to be received by and friction fitted to said composite;

wherein said connectors are hollow and have an outer wall and an inner wall; and wherein said connectors further comprise a plurality of covered channels extending the length of said inner wall of said connectors, and which are adapted to receive a series of screw fasteners for mounting said connectors to said composite rails.

11. The handrail system kit as claimed in claim 10 wherein said internal reinforcing element is a wood member friction fitted into said composite channel.

* * * * *